US007579991B2

(12) United States Patent
Mitsui

(10) Patent No.: US 7,579,991 B2
(45) Date of Patent: Aug. 25, 2009

(54) PORTABLE WIRELESS APPARATUS

(75) Inventor: Tsutomu Mitsui, Yokohama-si (JP)

(73) Assignee: Samsung Electronics Co., Ltd. (KR)

( * ) Notice: Subject to any disclaimer, the term of this patent is extended or adjusted under 35 U.S.C. 154(b) by 113 days.

(21) Appl. No.: 11/641,209

(22) Filed: Dec. 19, 2006

(65) Prior Publication Data

US 2007/0171136 A1 Jul. 26, 2007

(30) Foreign Application Priority Data

Dec. 19, 2005 (JP) ..... 2005-364723
Jul. 20, 2006 (KR) ..... 10-2006-0068095

(51) Int. Cl.
*H01Q 1/38* (2006.01)
*H01Q 1/48* (2006.01)

(52) U.S. Cl. ..... 343/700 MS; 343/846

(58) Field of Classification Search ..... 343/700 MS, 343/702, 846
See application file for complete search history.

(56) References Cited

U.S. PATENT DOCUMENTS

| | | | | |
|---|---|---|---|---|
| 6,292,141 | B1 * | 9/2001 | Lim | 343/700 MS |
| 6,624,789 | B1 * | 9/2003 | Kangasvieri et al. | 343/702 |
| 7,215,288 | B2 * | 5/2007 | Park et al. | 343/702 |
| 7,268,730 | B2 * | 9/2007 | Park et al. | 343/700 MS |
| 2006/0170593 | A1 * | 8/2006 | Watts | 343/700 MS |

FOREIGN PATENT DOCUMENTS

JP 2003-198409 7/2003

* cited by examiner

*Primary Examiner*—Shih-Chao Chen
(74) *Attorney, Agent, or Firm*—McNeely Bodendorf LLP

(57) ABSTRACT

Provided is a portable wireless apparatus having a reduced leakage current. The apparatus includes an antenna having an antenna ground plate on which is disposed an antenna element a circuit ground plate having a larger size than the antenna ground plate and included in a circuit substrate, and a connecting conductor connecting the antenna ground plate with the circuit ground plate.

18 Claims, 11 Drawing Sheets

PORTABLE WIRELESS APPARATUS

PRIORITY

This application claims the benefit of Japanese Patent Application No. 2005-364723, filed on Dec. 19, 2005, in the Japanese Intellectual Property Office, and Korean Patent Application No. 10-2006-0068095, filed on 20 Jul. 2006, in the Korean Intellectual Property Office, the contents of both of which are incorporated herein by reference.

BACKGROUND OF THE INVENTION

1. Field of the Invention

The present invention relates generally to a portable wireless apparatus, and more particularly, to a portable wireless apparatus in which a leakage current generated in a circuit ground plate included in a circuit substrate is reduced.

2. Description of the Related Art

In a portable wireless apparatus such as a Personal Data Assistant (PDA) and a notebook computer, a circuit including a base band circuit generates noise due to a high frequency characteristic of a wireless part. In order to prevent noise, a wireless part substrate including an antenna and a circuit substrate are conventionally separated from each other.

However, the antenna and the circuit substrate are partly electrically connected by a feeder. Thus, a leakage current from the antenna flows to the circuit substrate and a circuit ground plate included in the circuit substrate. A large circuit substrate greatly affects antenna radiation patterns and a communication band. For example, in the conventional portable wireless apparatus including a large circuit ground plate, antenna radiation patterns have a peak toward the circuit ground plate, which is not preferable for radio communication.

In addition, in the portable wireless apparatus, a current distribution of a current flowing in the circuit substrate is affected by the position of the hand of a user, for example, which influences the characteristics of the portable wireless apparatus.

Japanese Patent Laid-Open Publication No. 2003-198409 discloses a device for reducing the influence of the leakage current of the antenna. According to the disclosed device, the leakage current is reduced by separating a wireless part substrate from a control substrate in a parallel direction to both substrates and specifying a position of a connector. However, the device has a complicated structure and is not suitable for an antenna array or a similar structure.

SUMMARY OF THE INVENTION

The present invention provides a portable wireless apparatus in which a leakage current from an antenna is reduced.

According to the present invention, there is provided a portable wireless apparatus including an antenna having an antenna ground plate on which is disposed an antenna element, a circuit ground plate having a larger size than the antenna ground plate and is included in a circuit substrate, and a connecting conductor connecting the antenna ground plate to the circuit ground plate.

The antenna element is preferably a print pattern formed on a dielectric substance, and is one of a monopole antenna, an inverted F antenna, and a patch antenna.

The antenna element is preferably formed on each of a plurality of antenna ground plates, which are connected in parallel to the circuit ground plate by a plurality of connecting conductors.

BRIEF DESCRIPTION OF THE DRAWINGS

The above and other features and advantages of the present invention will become more apparent by a detailed description of the preferred embodiments thereof with reference to the attached drawings in which.

DETAILED DESCRIPTION OF THE INVENTION

The present invention will now be described more fully with reference to the accompanying drawings, in which exemplary embodiments of the invention are shown. The invention may, however, be embodied in many different forms and should not be construed as being limited to the embodiments set forth herein; rather, these embodiments are provided to fully convey the concept of the invention to those skilled in the art.

Figure 1:
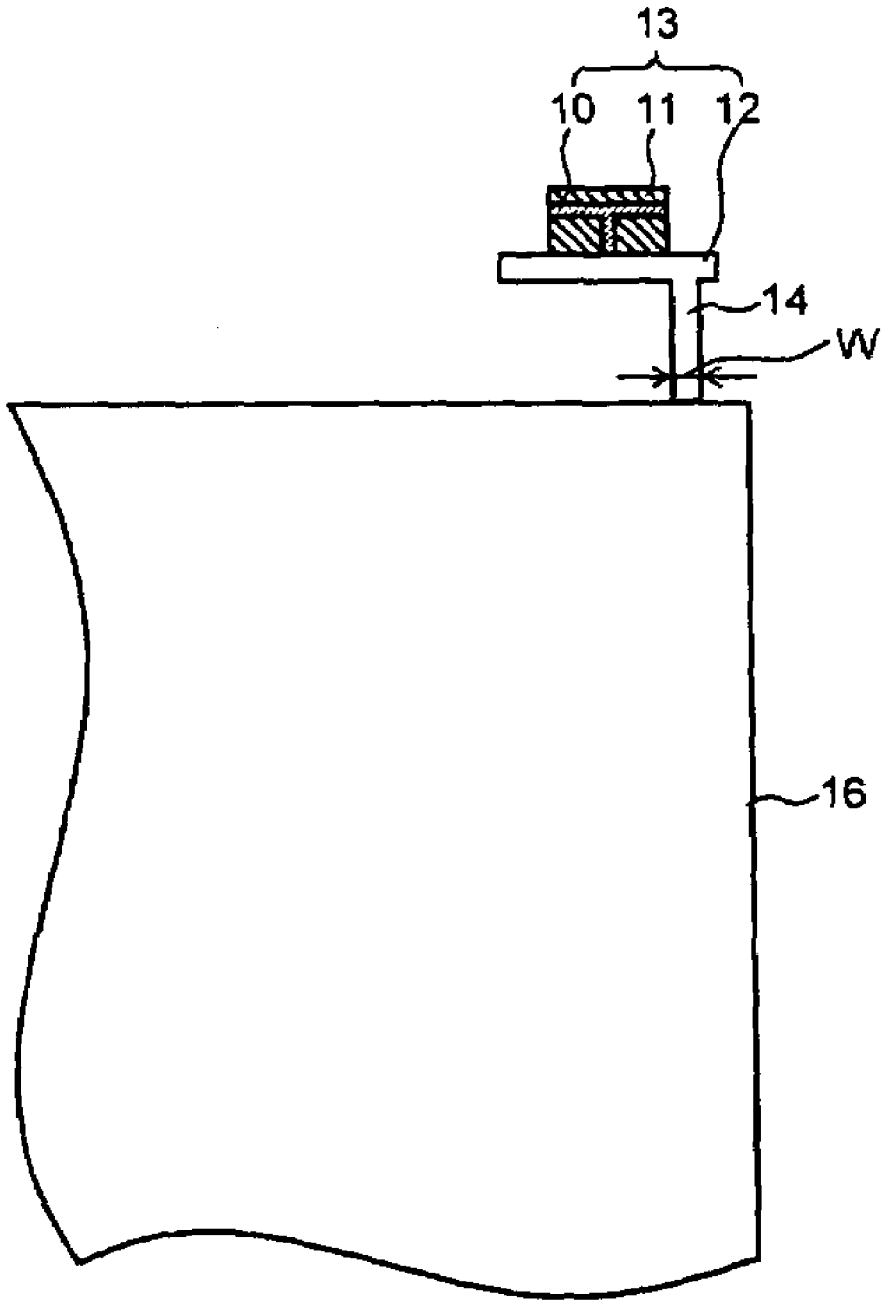
FIG. 1 is a view illustrating components of a portable wireless apparatus according to the present invention.

FIG. 1 is a view illustrating components of a portable wireless apparatus according to the present invention.

Referring to FIG. 1, the portable wireless apparatus includes an antenna 13 having a small-sized monopole, a circuit substrate, and a connecting conductor 14. Here, the antenna 13 includes a T-shaped antenna element 10 arranged on antenna ground plate 12. A circuit ground plate 16 is formed on a back side of the circuit substrate. The antenna ground plate 12 is electrically connected to the circuit ground plate 16 via the connecting conductor 14.

One end of the T-shaped antenna element 10 is connected to a feeder (not shown). For example, the T-shaped antenna element 10 is formed on a dielectric substance 11 having a size of 8 mm×8 mm×5 mm to have the form of a T-shaped printed pattern. A lower end of the T-shaped antenna element 10 is connected to the feeder.

The circuit substrate may include parts of a circuit embedded on a front side and the circuit ground plate 16 on the back side. An area of the circuit ground plate 16 is greater that that of the antenna ground plate 12. For example, when the circuit ground plate 16 has a size of 123 mm×70 mm, the antenna ground plate 12 has a size of 12 mm×10 mm. Here, the thickness of the antenna ground plate 12 is 1 mm.

The antenna ground plate 12 and the circuit ground plate 16 are connected to each other by the connecting conductor 14 having a width W of 3 mm. A sectional shape of the connecting conductor 14 may be, for example, or a circle a square. The width W of the connecting conductor 14 may be narrow in comparison with a wavelength of a transmitted/received wave, which will be described later.

Figure 2:
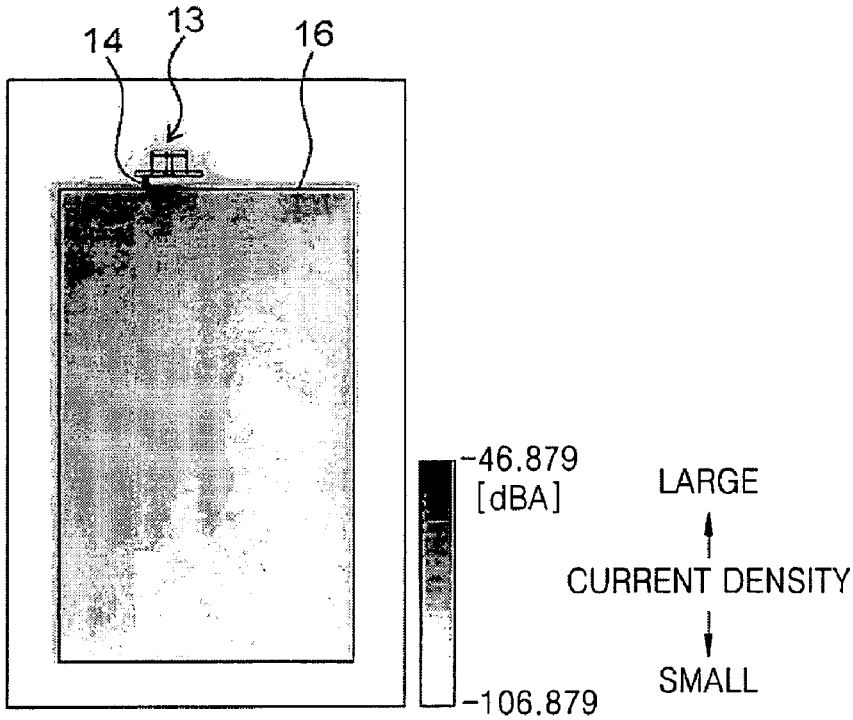
FIG. 2 is a view illustrating simulation results of a current distribution on a circuit ground plate when the width of a connecting conductor is narrow, according to the present invention.

FIG. 2 is a view illustrating simulation results of current distribution in the circuit ground plate 16, according to f the present invention. In FIG. 2, the antenna 13 and the circuit ground plate 16 have the sizes as described with respect to FIG. 1. Here, the width of the connecting conductor 14 is 1 mm (about 0.0175 λ), which is smaller than that in FIG. 3, described later. The frequency of the radio wave emitted by the antenna 13 is 5.25 GHz. An area, where a leakage current of the antenna 13 is large on the circuit ground plate 16, locally shows a high current density. Thus, the dark area is an area where a leakage current is large. The light area is an area where the leakage current is small. The simulation results in FIG. 2 were obtained using a Finite Difference Time Domain (FDTD) method in which the Maxwell's equation for the center of the circuit ground plate 16 was differentiated with respect to time and length.

Figure 3:
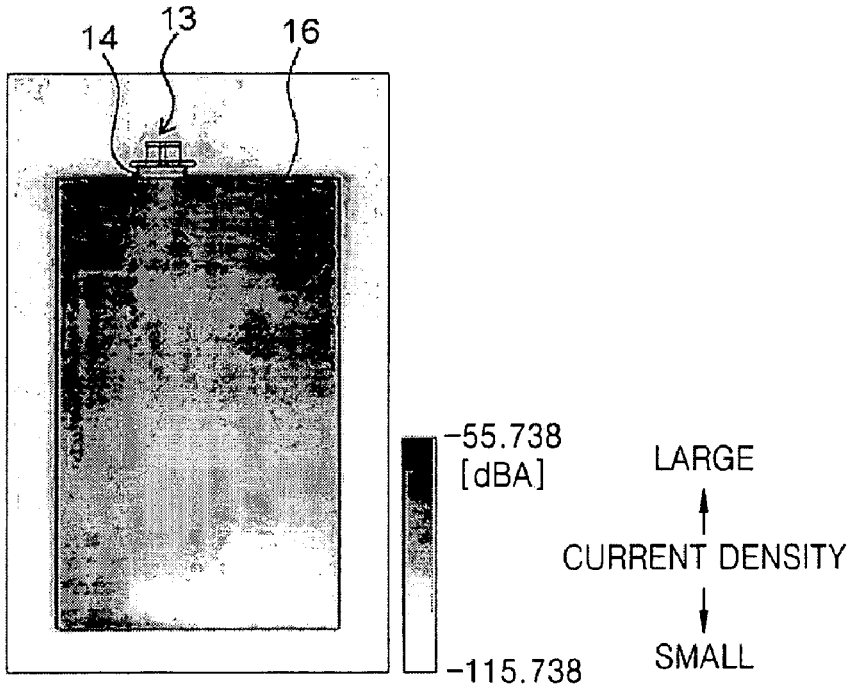
FIG. 3 is a view illustrating simulation results of a current distribution on a circuit ground plate when the width of a connecting conductor is wide, according to the present invention.

FIG. 3 is a view illustrating simulation results of current distribution in the circuit ground plate 16, according to the present invention. In FIG. 3, the width W of the connecting conductor 14 is 12 mm (about 0.21λ), which is greater than that in FIG. 2. The antenna 13 and the circuit ground plate 16 have the same sizes as described with respect to FIG. 1.

As illustrated in FIGS. 2 and 3, the antenna ground plate 12 and the circuit ground plate 16 are connected to each other via the connecting conductor 14, and thus the leakage current of the antenna 13 is smaller. As illustrated in FIG. 2, the width of the connecting conductor 14 is narrower than that in FIG. 3. Thus, the dark area, where the leakage current is large, is smaller than that in FIG. 3.

Figure 4:
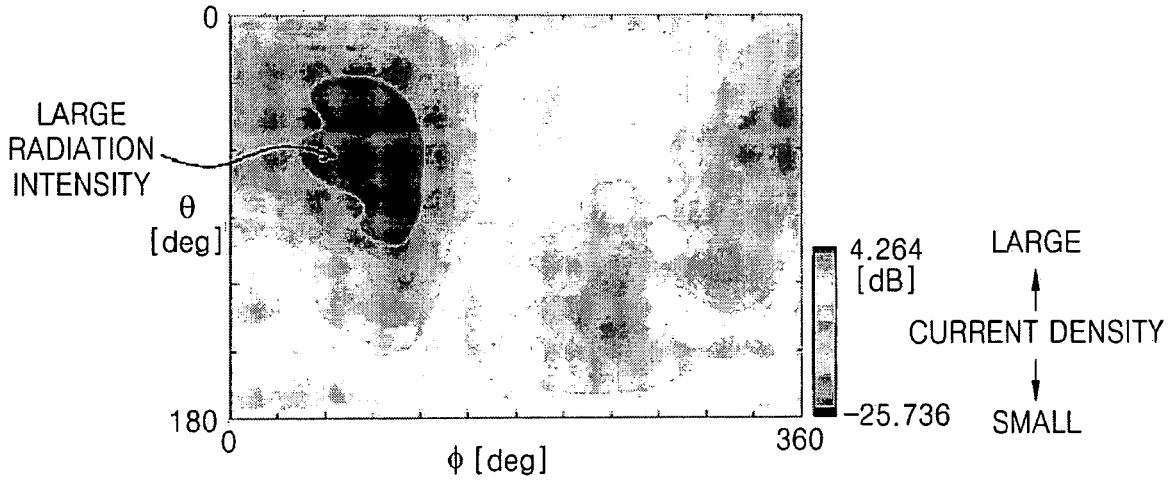
FIG. 4 is a graph illustrating radiation patterns of the antenna used to obtain the simulation results of FIG. 2 when the width of a connecting conductor is narrow, according to the present invention.
Figure 5:
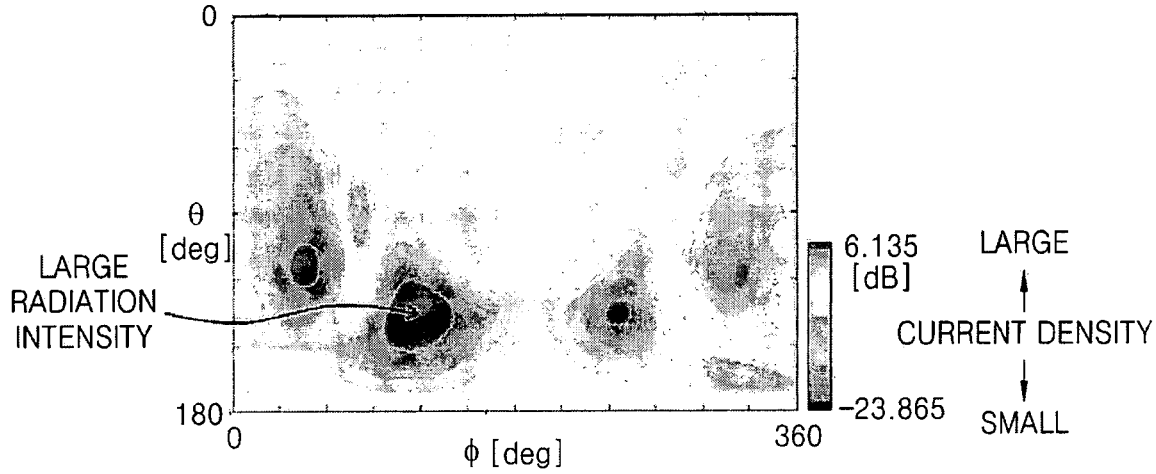
FIG. 5 is a graph illustrating radiation patterns of the antenna used to obtain the simulation results of FIG. 3 when the width of a connecting conductor is wide, according to the present invention.

FIG. 4 is a graph illustrating radiation patterns of the antenna 13 used to obtain the simulation results in FIG. 2, according to the present invention. FIG. 5 is a graph illustrating radiation patterns of the antenna 13 used to obtain the simulation results in FIG. 3, according to the present invention. The radiation patterns are those of a far field.

Figure 6:
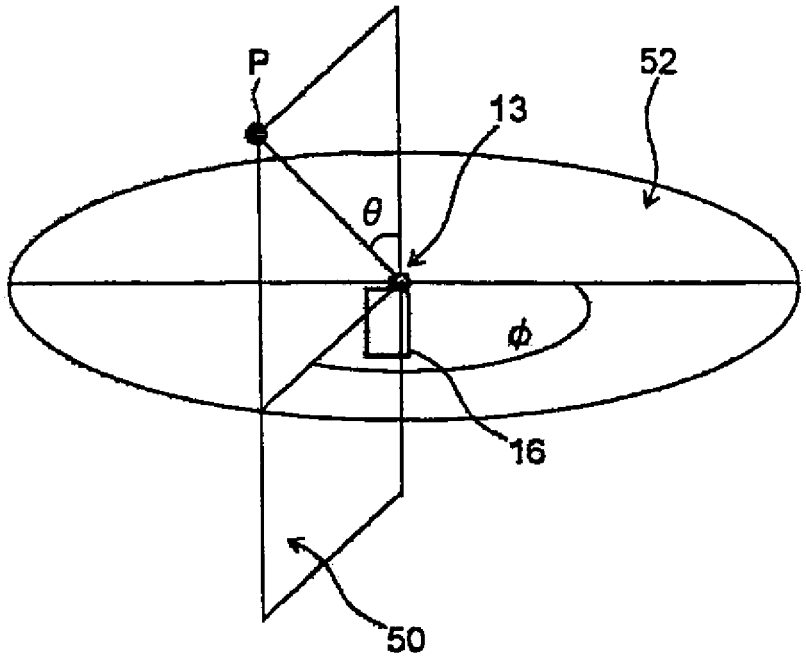
FIG. 6 is a view illustrating angles of the radiation patterns of FIGS. 4 and 5.

FIG. 6 is a view for illustrating angles of the radiation patterns of FIGS. 4 and 5.

Referring to FIG. 6, the origin of the system of coordinate is the antenna 13. P is the zenith of the antenna 13 and is defined by angle θ in a perpendicular plane 50 with respect to a perpendicular axis and angle ϕ in a horizontal plane 52 with respect to a horizontal axis. In view of the directivity of the radiation intensity of the antenna 13, the radiation intensity at P(θ, ϕ), which is far enough from the antenna 13, has a pattern as illustrated in FIGS. 4 and 5. Referring to FIGS. 4 and 5, a perpendicular axis of the graph corresponds to θ, and a horizontal axis of the graph corresponds to ϕ.

Referring to FIG. 4, when the width of the connecting conductor 14 is narrow, the peak angle $\theta_P$ of the radiation intensity is about 70 degrees in the perpendicular plane and is slightly directed upward. Thus, a portable wireless apparatus, of which the width of the connecting conductor 14 is narrow, is preferable. The peak angle $\phi_P$ of the radiation intensity is about 90 degrees in the horizontal plane.

Referring to FIG. 5, when the width of the connecting conductor 14 is greater than that of FIG. 4, the peak angle $\theta_P$ of the radiation intensity is about 140 degrees in the perpendicular plane and is directed downward with respect to the horizontal plane. The peak angle $\phi_P$ of the radiation intensity is about 120 degrees.

Comparing FIG. 4 to FIG. 5, it can be seen that a portable wireless apparatus, of which the width of the connecting conductor 14 is narrow, is preferable since the peak angle $\theta_P$ of the radiation intensity is directed upward with respect to the horizontal plane.

Figure 7:
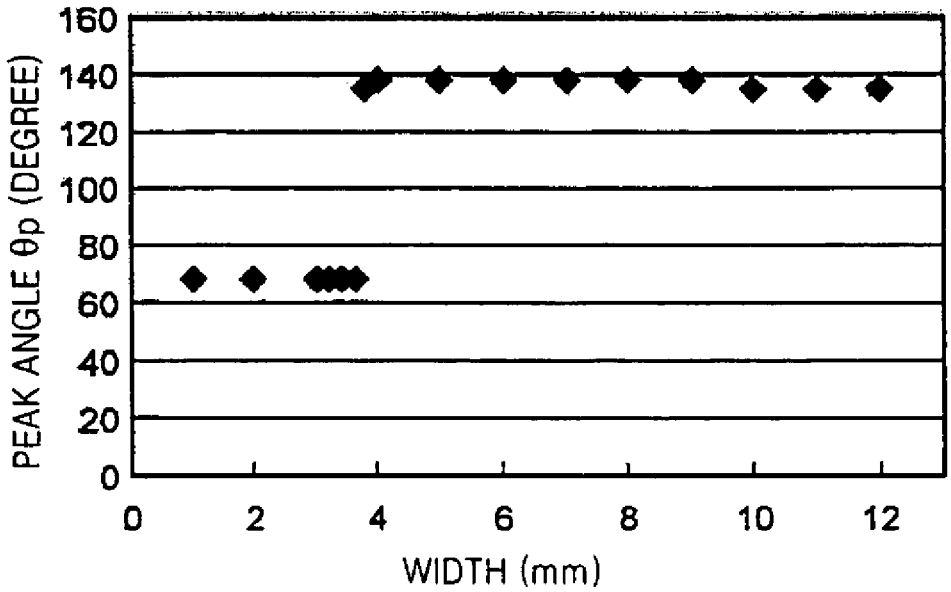
FIG. 7 is a simulation graph of a peak angle $\theta_P$ of a radiation intensity versus the width of the connecting conductor, according to the present invention.

FIG. 7 is a simulation graph illustrating a dependence of the peak angle $\theta_P$ of radiation intensity upon the width of the connecting conductor 14, according to the present invention. A perpendicular axis of the graph corresponds to the peak angle $\theta_P$ of the radiation intensity. A horizontal axis of the graph corresponds to the width (W, mm) of the connecting conductor 14. The width W may range from 1 through 12 mm. A portable wireless apparatus of which width W of the connecting conductor 14 is less than 3.8 mm (0.067λ) is preferable since the peak angle $\theta_P$ of the radiation intensity is 70 degrees. Thus, the peak angle $\theta_P$ of the radiation intensity is directed upward with respect to the horizontal plane. When the width of the connecting conductor 14 is thicker than 3.8 mm, the peak angle $\theta_P$ of the radiation intensity is about 140 degrees. Thus, the peak angle $\theta_P$ of the radiation intensity is directed downward. Accordingly, communication is possible even when a position angle of the antenna 13 is changed. However, when the peak angle $\theta_P$ of the radiation intensity is 70 degrees, the antenna 13 can be used easily. Thus, the width of the connecting conductor 14 may be less than 0.067 times the wavelength of the radio wave emitted by the antenna 13.

Figure 8:
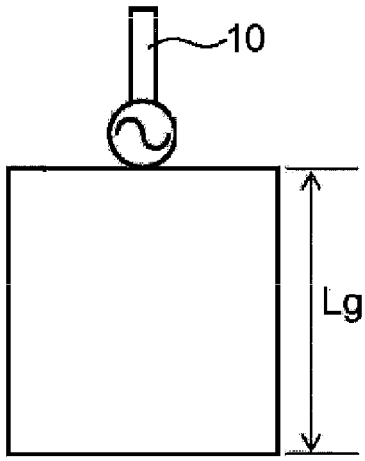
FIG. 8 is a view illustrating a comparative example of a portable wireless apparatus including an antenna.
Figure 9:
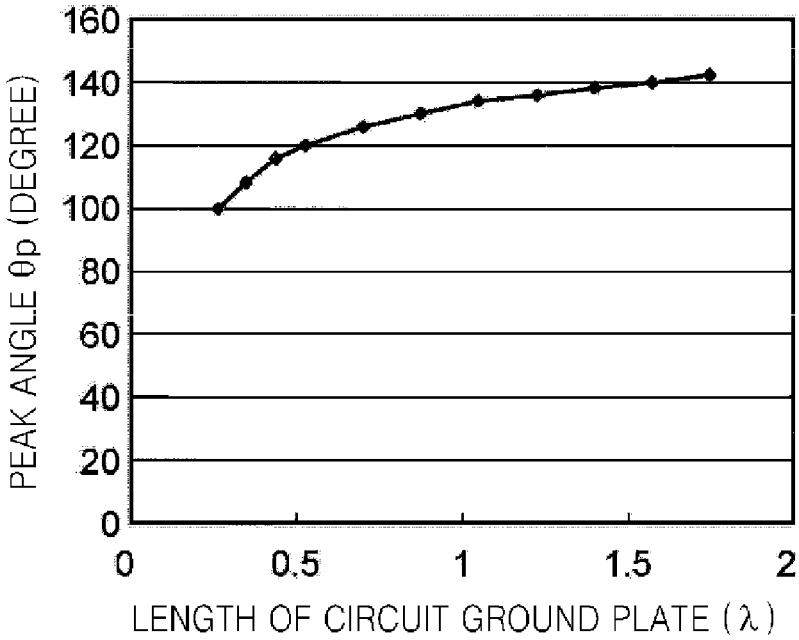
FIG. 9 is a simulation graph illustrating a dependence of a peak angle $\theta_P$ of a radiation intensity upon a length of a circuit ground in the portable wireless apparatus of FIG. 8.

Referring to FIGS. 8 and 9, a relation between the peak angle $\theta_P$ of radiation intensity and a circuit substrate plate of a circuit substrate in a comparative example of a portable wireless apparatus is presented. The portable wireless apparatus in FIG. 8 is substantially the same as portable wireless apparatus described above except that it does not include an antenna ground plate from which an antenna of the portable wireless apparatus is separated.

FIG. 9 is a simulation graph illustrating a dependence of the peak angle $\theta_P$ of radiation intensity upon a length Lg of the circuit ground in the portable wireless apparatus of FIG. 8.

Referring to FIG. 9, the greater the length of the circuit ground Lg, the greater the peak angle $\theta_P$ of the radiation intensity. For example, when the length of the circuit ground Lg is 0.5λ, the peak angle $\theta_P$ is about 116 degrees. When the length of the circuit ground is 1.5λ, the peak angle $\theta_P$ is about 140 degrees. In both cases the peak angle $\theta_P$ of the radiation intensity is directed downward with respect to the horizontal plane. Thus, in the portable wireless apparatus of FIG. 8, it is difficult to obtain a upward peak angle $\theta_P$ such as 70 degrees which may be obtained in the present invention.

However, as illustrated in FIG. 1, the small-sized antenna ground plate 12 included in the antenna 13 and the large-sized circuit ground plate 16 of the circuit substrate are connected by the connecting conductor 14 of which width W is narrow enough in comparison with a wavelength of a transmitted/received wave, which will be described later. Accordingly, it can be seen that the antenna ground plate 12 and the circuit ground plate 16 of the circuit substrate are electrically connected in a low frequency current or a direct current, but are independent from each other in a high frequency current. Thus, a leakage current, which is directed from the antenna 13 to the circuit ground plate 16, can be reduced. In addition, as illustrated in FIG. 4, since the peak angle $\theta_P$ is directed upward with respect to the horizontal plane, the portable wireless apparatus of FIG. 1 has preferable radiation properties.

Figure 10:
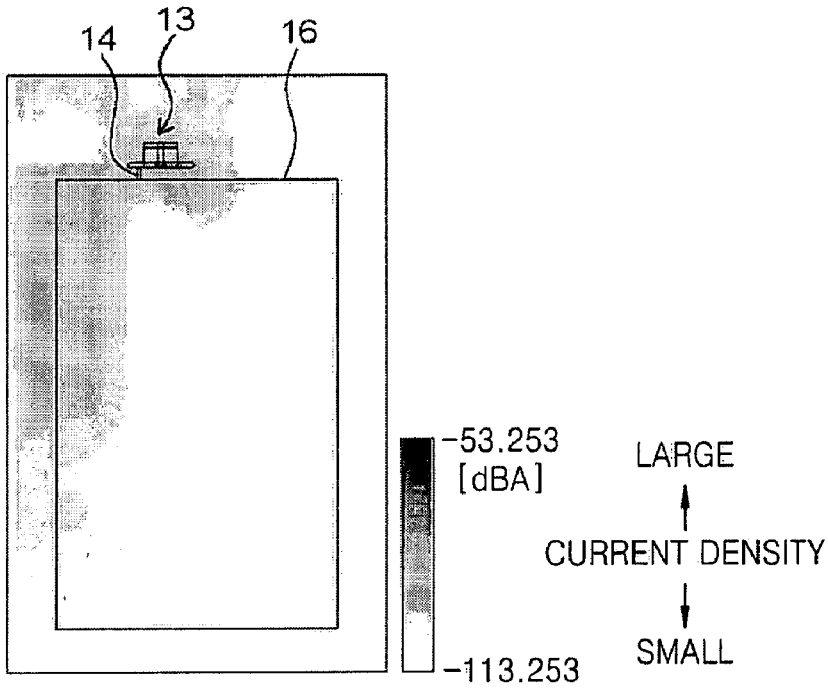
FIG. 10 is a view illustrating simulation results of a leakage current when a connecting conductor is formed on an end of an antenna ground plate, according to the present invention.
Figure 11:
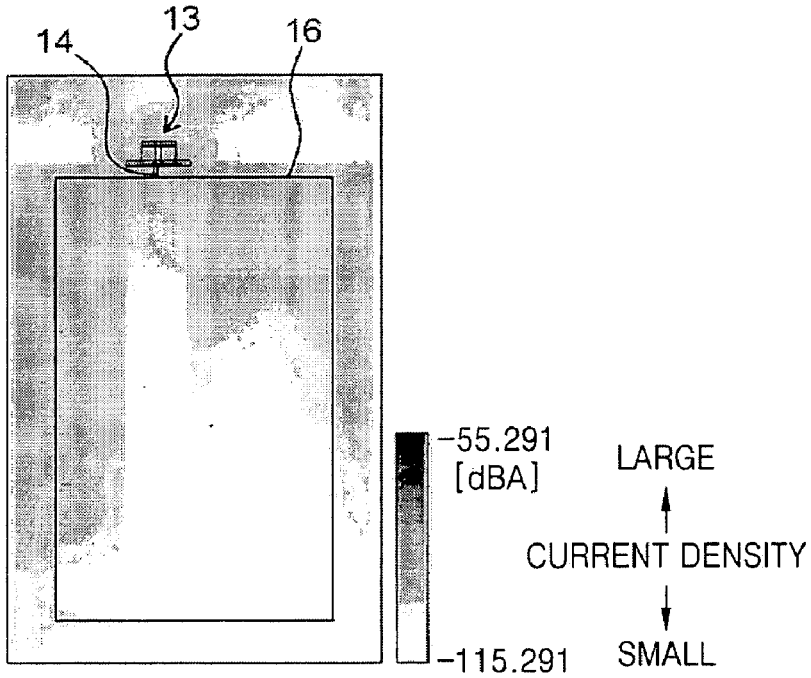
FIG. 11 is a view illustrating simulation results of a leakage current when a connecting conductor is formed on a center part of an antenna ground plate, according to the present invention.

FIG. 10 is a view illustrating simulation results of a leakage current when the connecting conductor 14 is formed on an end of the antenna ground plate (12 of FIG. 1), according to the present invention. FIG. 11 is a view illustrating simulation results of a leakage current when the connecting conductor 14 is formed on a center part of the antenna ground plate 12, according to the present invention. A dark area is an area where the leakage current of the antenna 13 is large, and a light area is an area where the leakage current of the antenna 13 is small. The sizes of the antenna 13 and the circuit ground plate 16 are substantially the same as described with respect to FIG. 1. A frequency of a radio wave emitted by the antenna 13 may be about 5.25 GHz.

Referring to FIGS. 10 and 11, the antenna ground plate 12 and the circuit ground plate 16 of the circuit substrate are connected via the connecting conductor 14 having the narrow width. Thus, the leakage current of the antenna 13 may be reduced. As illustrated in FIG. 10, when the connecting conductor 14 is formed on an end of the antenna ground plate 12, a dark area, in which the leakage current of the antenna 13 is large, is smaller than that of FIG. 11.

Figure 12:
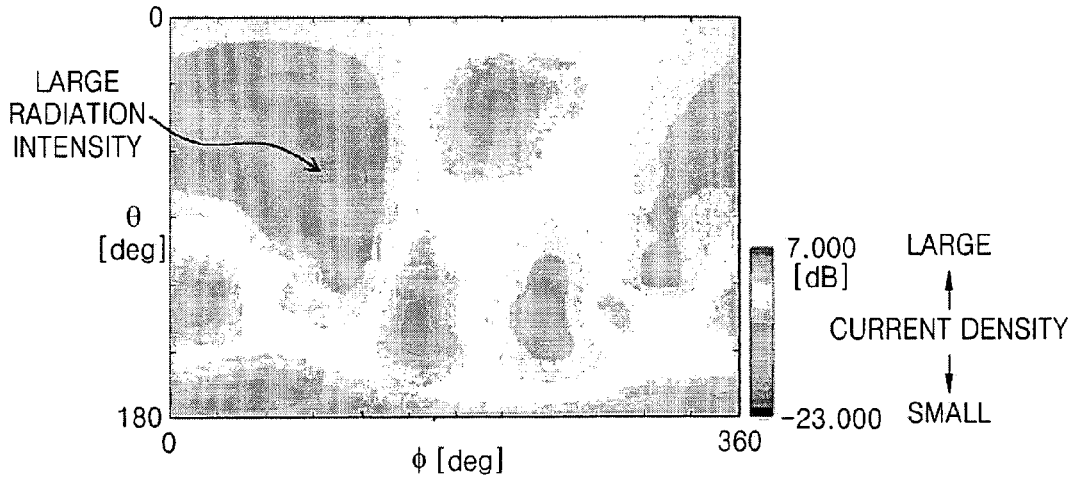
FIG. 12 is a view illustrating radiation patterns of the antenna of FIG. 10 with respect to perpendicular and horizontal planes.
Figure 13:
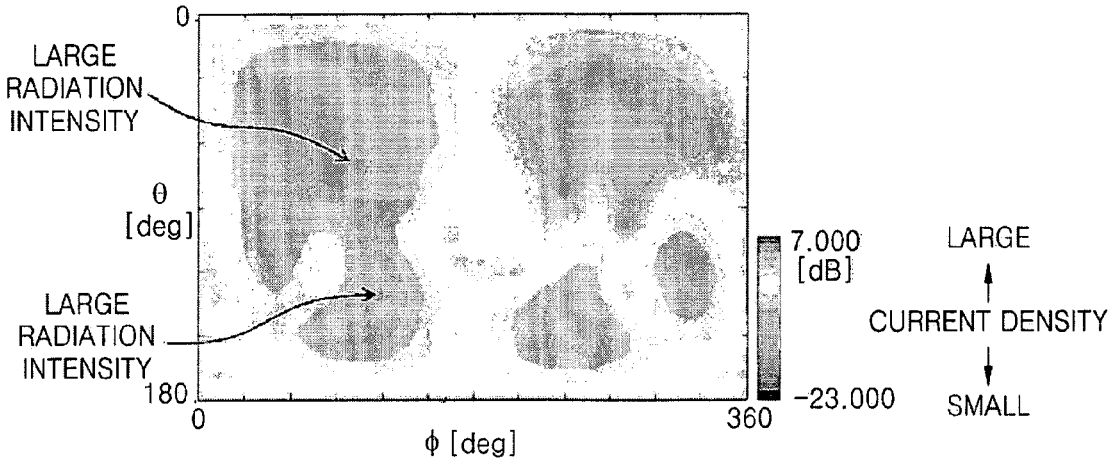
FIG. 13 is a view illustrating radiation patterns of the antenna of FIG. 11 with respect to perpendicular and horizontal planes.

FIG. 12 is a view illustrating radiation patterns of the antenna of FIG. 10 with respect to perpendicular and horizontal planes. FIG. 13 is a view illustrating radiation patterns of the antenna of FIG. 11 with respect to perpendicular and horizontal planes.

Referring to FIG. 12, since the peak angle $\theta_P$ of the radiation intensity is about 70 degrees in the perpendicular plane and the radiation intensity is slightly directed upward when the connecting conductor 14 is formed on an end of the antenna ground plate 12, the antenna of FIG. 10 may be used in a portable wireless apparatus. The peak angle $\phi_P$ of the radiation intensity is about 90 degrees in the horizontal plane.

Figure 14:
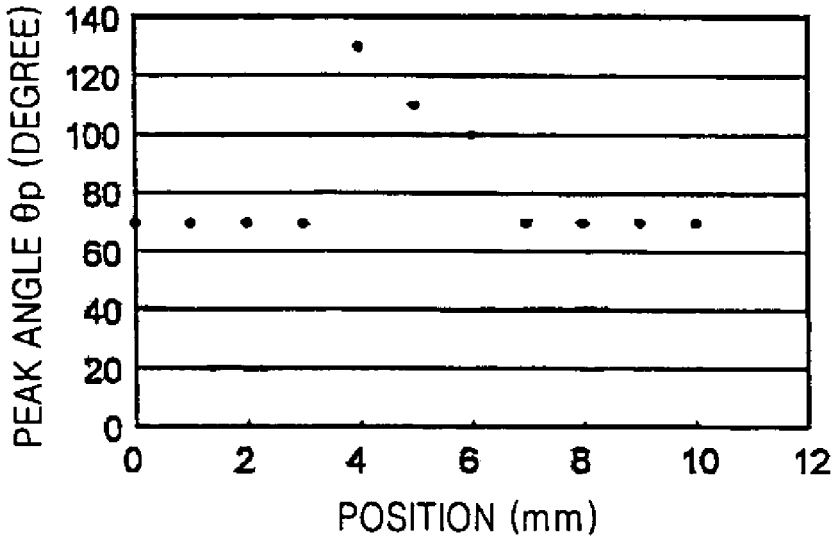
FIG. 14 is a simulation graph illustrating a dependence of a peak angle $\theta_P$ with respect to a horizontal plane of a radiation intensity upon a position of the connecting conductor, according to the present invention.

Referring to FIG. 13, when the connecting conductor 14 is formed on a center part of the antenna ground plate 12, the peak angle θp of the radiation intensity is in the range of 70 through 130 degrees in the perpendicular plane and the peaks of the radiation intensity are found at two positions. FIG. 14 is a simulation graph illustrating the dependence of the peak angle θP with respect to a horizontal plane of a radiation intensity upon a position of the connecting conductor 14, according to the present invention.

Referring to FIG. 14, when the connecting conductor 14 is formed on a center part, which is 4.0 through 6.0 mm apart from an end of the antenna ground plate 12, the peak angle $\theta_P$ of the radiation intensity is in the range of 100 through 130 degrees and the peak angle $\theta_P$ of the radiation intensity is directed downward with respect to the horizontal plane. Thus, the portable wireless apparatus can be used by slightly modifying the antenna angle. However, since the peak angle θp of the radiation intensity is about 70 degrees and it directed toward with respect to the horizontal plane when the connecting conductor 14 is formed on an end of the antenna ground plate 12, the portable wireless apparatus of this case is preferable.

Figure 15:
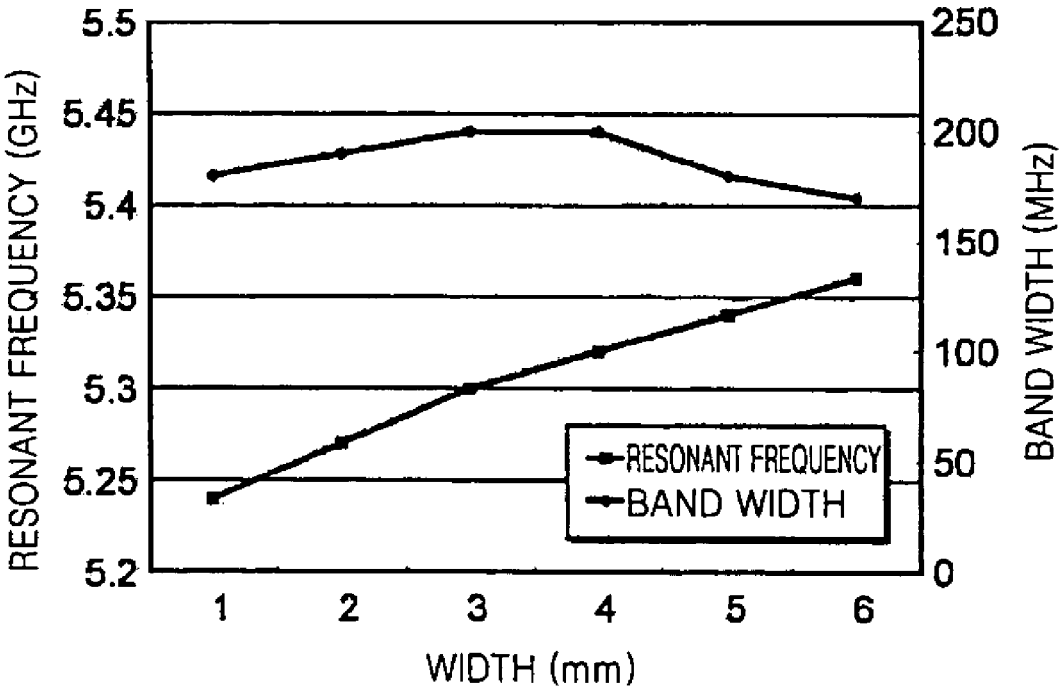
FIG. 15 is a simulation graph illustrating a dependence of a resonant frequency and a band width upon a width W of a connecting conductor, according to the present invention.

FIG. 15 is a simulation graph illustrating a dependence of a resonant frequency and a band width upon the width W of the connecting conductor 14, according to the present invention. In FIG. 15, the connecting conductor 14 is formed on an end of the antenna ground plate 12. A perpendicular axis of the graph is the resonant frequency and the band width. The horizontal axis of the graph is the width W in mm of the connecting conductor 14. When the width W of the connecting conductor 14 is in the range of 1 through 6 mm, the resonant frequency is in the range of 5.24 through 5.36 GHz. The narrower the width W of the connecting conductor 14, the lower the resonant frequency. Thus, a small-sized antenna is realized. In addition, when the width W of the connecting conductor 14 is in the range of 1 through 6 mm, the band width may be varied in the range of 170 through 200 MHz.

Figure 16:
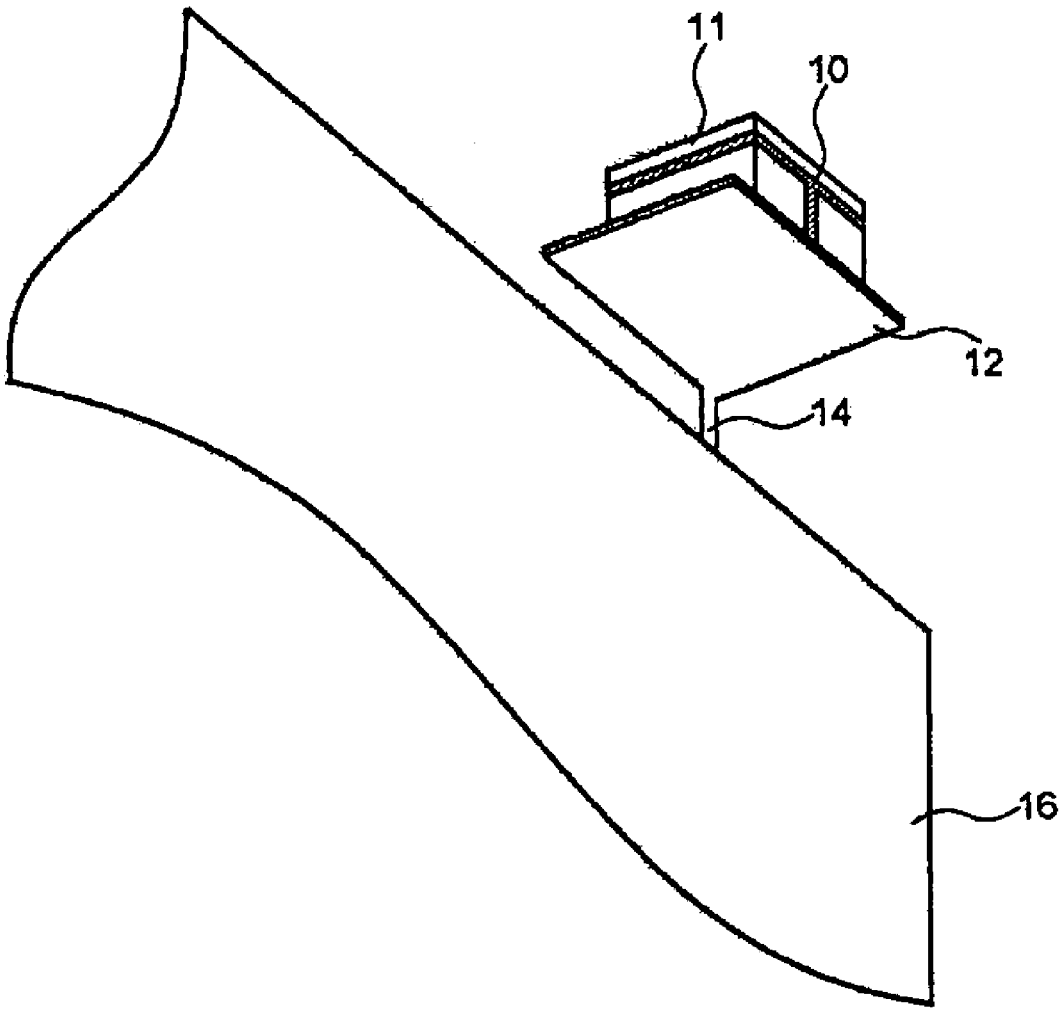
FIG. 16 is a view illustrating a portable wireless apparatus constructed according to the results of FIG. 15, according to the present invention.

FIG. 16 is a view illustrating a portable wireless apparatus constructed according to the simulation results of FIG. 15, according to the present invention.

The connecting conductor 14 is formed of a metal and located on an end of the antenna ground plate 12. The width W of the connecting conductor 14 is less than 1 mm (almost 0.0175λ) and it is narrow in comparison with the wavelength. Thus, the leakage current of the circuit ground plate 16 of the circuit substrate can be reduced. The antenna element 10 is of a monopole type. The portable wireless apparatus according to FIG. 16 can be used in a $4^{th}$ generation portable wireless apparatus and a Personal Data Assistant (PDA).

Figure 17:
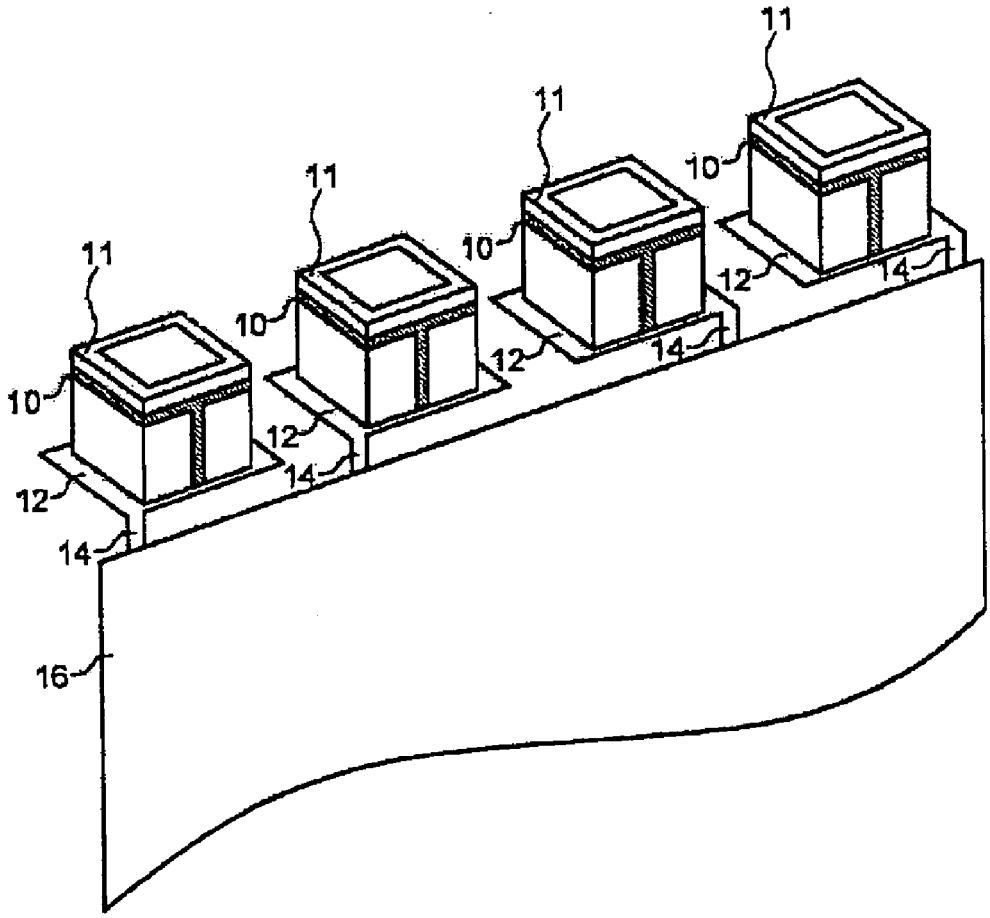
FIG. 17 is a perspective view illustrating a first embodiment of an antenna part of a portable wireless apparatus according to the present invention.

FIG. 17 is a perspective view illustrating a first embodiment of an antenna part of a portable wireless apparatus according to the present invention. The portable wireless apparatus invention includes an array antenna including 4 small-sized antenna elements of FIG. 16. The portable wireless apparatus of FIG. 17 is a variation of the portable wireless apparatus of FIG. 16.

Referring to FIG. 17, the antenna of the portable wireless apparatus includes 4 antenna elements 10 and 4 antenna ground plates 12 each including one of the antenna elements 10. The antenna ground plates 12 are respectively connected to a circuit ground plate 16 via 4 connecting conductors 14. That is, the 4 antenna ground plates 12 are connected in parallel to the circuit ground plate 16 via the connecting conductors 14.

The portable wireless apparatus including the array antenna according to the first embodiment can be manufactured to have a small size, which allows the leakage current of the antenna to be reduced. The portable wireless apparatus the present invention can be used in a communication mode, in which a plurality of transmit/receipt antennas are necessary, such as Multi Input Multi Output (MIMO).

Figure 18:
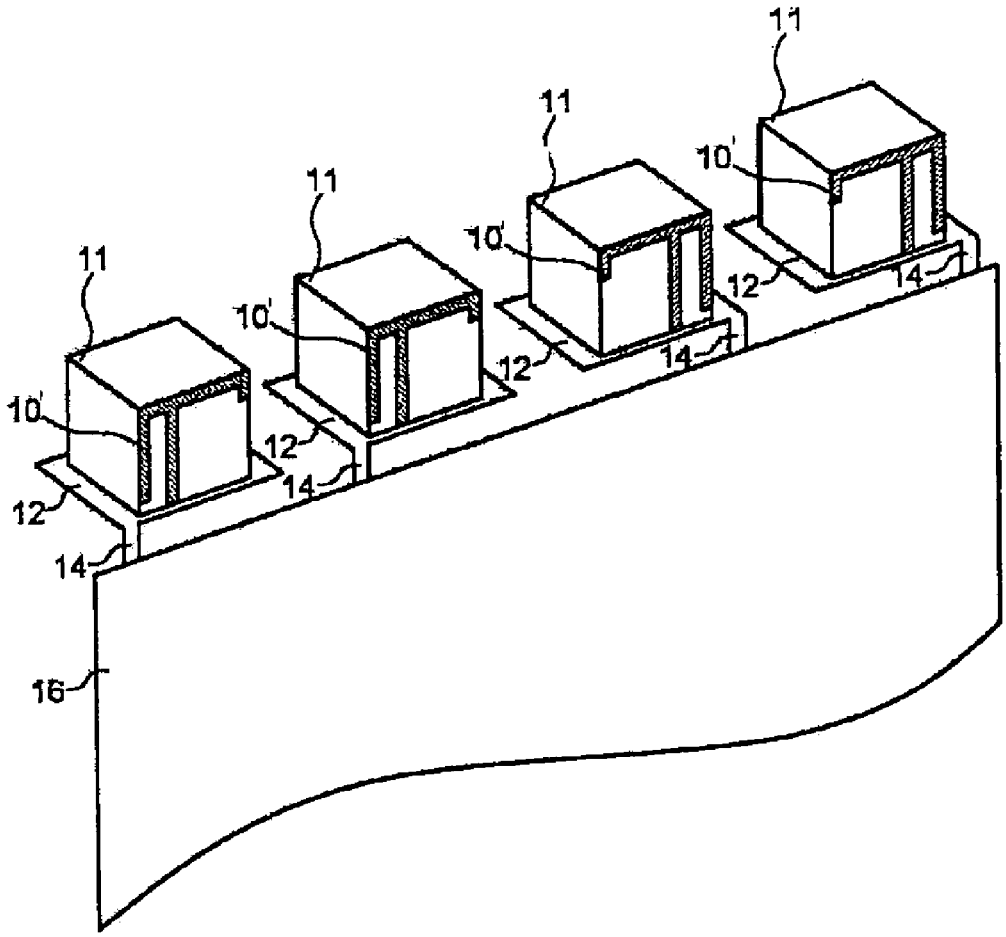
FIG. 18 is a perspective view illustrating a second embodiment of an antenna part of a portable wireless apparatus according to the present invention.

FIG. 18 is a perspective view illustrating a second embodiment of an antenna part of a portable wireless apparatus according to the present invention. The portable wireless apparatus includes an inverted F antenna as an antenna element 10'.

The inverted F antenna used in the portable wireless apparatus according to the second embodiment as compared to the portable wireless apparatus including the monopole antenna, presents different radiation patterns may be different, however, the tendencies of the radiation patterns are largely similar.

In particular, since the antenna ground plate 12 is connected to the circuit ground plate 16 via the connecting conductor 14, the leakage current can be reduced, which is substantially the same as for the above embodiments of the present invention. In addition, the portable wireless apparatus according to the second embodiment includes an array antenna including a plurality of antenna elements having the inverted F antenna embodied thereon, and thus it can be used in a communication mode such as MIMO.

The present invention has been particularly shown and described with reference to preferred embodiments thereof, but the present invention is not limited thereto. For example, it has been described that the antenna element is a monopole antenna or an inverted F antenna, but the antenna element may be a patch antenna. In this case, the antenna element includes a patch which is formed of a metal thin layer on one surface of a dielectric substrate of the antenna element. The other surface of the dielectric substrate is attached on the antenna ground plate, or alternatively, it is formed separated at a predetermined interval from the antenna ground plate.

It will be understood by those of ordinary skill in the art that various changes in size, shape, material and distribution correlation of constituents such an antenna element and an antenna ground plate included in an antenna, a connecting conductor, a circuit substrate, a circuit ground plate, or the like may be made without departing from the spirit and scope of the present invention.

According to the present invention, a circuit ground plate and a ground plate are connected with respect to a direct current, but they are independent in a high frequency current. Thus, the leakage current of the antenna generated in the circuit ground plate is reduced, and simultaneously the radiation patterns can be directed upward with respect to a horizontal plane. The radiation pattern having upward directivity can be used in a portable wireless apparatus.

While the present invention has been particularly shown and described with reference to preferred embodiments thereof, it will be understood by those of ordinary skill in the art that various changes in form and details may be made therein without departing from the spirit and scope of the present invention as defined by the following claims.

What is claimed is:

1. A portable wireless apparatus comprising:

an antenna including an antenna ground plate having an antenna element disposed thereon;

a circuit ground plate having a larger size than the antenna ground plate and included on a circuit substrate; and a connecting conductor connecting the antenna ground plate with the circuit ground plate.

2. The portable wireless apparatus of claim 1, wherein a width of the connecting conductor is less than at least 0.067 times a wavelength of a radio wave emitted by the antenna element.

3. The portable wireless apparatus of claim 1, wherein the connecting conductor is connected to the antenna ground plate on a position offset from a center of the antenna ground plate.

4. The portable wireless apparatus of claim 3, wherein the connecting conductor is connected to an end of the antenna ground plate.

5. The portable wireless apparatus of claim 1, wherein the circuit ground plate is formed on a back side of the circuit substrate.

6. The portable wireless apparatus of claim 1, wherein the antenna element is a print pattern formed on a dielectric substance.

7. The portable wireless apparatus of claim 6, wherein the antenna element is one of a monopole antenna, an inverted F antenna, and a patch antenna.

8. The portable wireless apparatus of claim 1, wherein the antenna ground plate and the circuit ground plate are perpendicular to each other.

9. The portable wireless apparatus of claim 1, wherein the antenna comprises an array structure including a plurality of antenna elements.

10. The portable wireless apparatus of claim 9, wherein each antenna element is formed on a corresponding one of a plurality of antenna ground plates.

11. The portable wireless apparatus of claim 10, wherein each of the plurality of antenna ground plates is connected in parallel to the circuit ground plate via a plurality of connecting conductors.

12. The portable wireless apparatus of claim 1, wherein a width of the connecting conductor is less than at least 0.067 times a wavelength of a radio wave emitted by the antenna element.

13. The portable wireless apparatus of claim 1, wherein the connecting conductor is connected to the antenna ground plate on a position offset from a center of the antenna ground plate.

14. The portable wireless apparatus of claim 1, wherein the antenna element is disposed on the antenna ground plate.

15. The portable wireless apparatus of claim 14, wherein the antenna element is a print pattern formed on a dielectric substance.

16. The portable wireless apparatus of claim 15, wherein the antenna element is one of a monopole antenna, an inverted F antenna, and a patch antenna.

17. The portable wireless apparatus of claim 1, wherein the antenna ground plate and the circuit ground plate are perpendicular to each other.

18. A portable wireless apparatus comprising:

an antenna including an antenna ground plate and an antenna element;

a circuit ground plate having a larger size than the antenna ground plate and included on a circuit substrate; and a connecting conductor connecting the antenna ground plate with the circuit ground plate, wherein the antenna ground plate is provided between the antenna element and the circuit ground plate.

* * * * *